US005370382A

United States Patent [19]

Wetter

[11] Patent Number: 5,370,382

[45] Date of Patent: Dec. 6, 1994

[54] APPARATUS FOR FORMING STACKS FROM FOLDED PRINTING PRODUCTS

[75] Inventor: Jakob Wetter, Wetzikon, Switzerland

[73] Assignee: Ferag AG, Hinwil, Switzerland

[21] Appl. No.: 96,014

[22] Filed: Jul. 21, 1993

[30] Foreign Application Priority Data

Jul. 22, 1992 [CH] Switzerland ..... 02309/92

[51] Int. Cl.[5] ..... B65H 29/04

[52] U.S. Cl. ..... 271/183; 271/188; 271/189; 271/204; 271/209; 271/218

[58] Field of Search ..... 271/189, 218, 182, 183, 271/188, 209, 204–206; 414/790.8

[56] References Cited

U.S. PATENT DOCUMENTS

| | | | |
|---|---|---|---|
| 3,298,683 | 1/1967 | Stroud | 271/189 X |
| 4,140,052 | 2/1979 | Meier . | |
| 4,214,743 | 7/1980 | Meier . | |
| 4,229,134 | 10/1980 | Reist . | |
| 4,432,685 | 2/1984 | Stauber . | |
| 4,445,681 | 5/1984 | Reist . | |
| 4,577,852 | 3/1986 | Grunder | 271/189 X |
| 5,002,456 | 3/1991 | Gösslinghoff . | |

FOREIGN PATENT DOCUMENTS

| | | |
|---|---|---|
| 1091707 | 11/1977 | Canada . |
| 2357658 | 11/1973 | Germany . |
| 566928 | 11/1973 | Switzerland . |
| 623286 | 12/1977 | Switzerland . |

OTHER PUBLICATIONS

Bindereport, "Three-Cutter for In-line Operation", Jul. 1992, pp. 398 and 399.

*Primary Examiner*—Richard A. Schacher

*Attorney, Agent, or Firm*—Bell, Seltzer, Park & Gibson

[57] ABSTRACT

The stack-forming device (10) has a stack compartment (20), which is closed at the bottom by slide plates (22) and to which printing products (16) are fed by the conveying device (14). Above the slide plates (22), intermediate-bottom elements (58) can be pushed into the stack compartment (20), on which elements the fed printing products (16) can be deposited one on top of the other at the beginning of a preliminary stack formation. As soon as a certain number of printing products have been stacked, the intermediate-bottom elements (58) are drawn out of the stack compartment (20), as a result of which the stacked printing products (16) fall onto the slide plates (22), and the preliminary stack is completed by feeding further printing products (16). The finished preliminary stack is then set down onto the depositing table (30) by moving the slide plates (22) apart. Said depositing table is lowered and, as soon as the preliminary stack has passed the intermediate-bottom elements (58), said elements are moved into the stack compartment (20) again, in order to permit the formation of a new preliminary stack.

15 Claims, 3 Drawing Sheets

APPARATUS FOR FORMING STACKS FROM FOLDED PRINTING PRODUCTS

BACKGROUND OF THE INVENTION

The present invention relates to an apparatus for forming stacks from folded printing products, such as newspapers, periodicals and the like, and to a process for operating this apparatus.

An apparatus of this type is known from DE-A-27 52 513 and the corresponding CA-A-1,091,707. A number of printing products are in each case fed in imbricated formation by means of a belt conveyor to a stack compartment, closed at the bottom by slide plates, where a preliminary stack is formed from the printing products. Then, the feeding of printing products into the stack compartment is interrupted and the slide plates are drawn apart in order to drop the preliminary stack into a receiving space of a bundle-forming unit onto a raisable and lowerable depositing table, closing off said receiving space at the bottom, or onto a preliminary stack already deposited onto said table. Then, the stack compartment is closed again at the bottom by pushing together the slide plates, so that the belt conveyor can again feed a number of printing products for the forming of a preliminary stack. The depositing table is turned, together with the receiving space, in each case after the take-over of a preliminary stack through 180° about the vertical axis, in order to form a finished stack from preliminary stacks turned with respect to one another. After turning, in each case the depositing table is raised in order to compress the printing products present in the receiving space between itself and the slide plates. Subsequently, the depositing table is lowered to such an extent that the printing products no longer bear against the slide plates, so that then the next preliminary stack can be received. As soon as a complete finished stack has been formed, the depositing table is lowered completely and the finished stack is ejected from the receiving space by means of an ejecting device.

In an operation processing printing products, the printing products usually arrive continuously. In order to be able to feed these continuously arriving printing products in the necessary number in each case to the stack compartment, either the belt conveyor is assigned a gap-forming device or a plurality of successively connected stack-forming devices are provided, the stack compartments of which are supplied alternately with the corresponding number of printing products. In the case of use of a gap-forming device, the gap is determined by the time which the stacking device requires to transfer a preliminary stack to the bundle-forming unit and to close the stack compartment again by the slide plates. During this time, the continuously arriving printing products are accumulated, which can adversely affect the speed with which they can subsequently be fed to the stack compartment, and the quality of the preliminary stack. Ultimately, the processing capacity is also determined by the said time.

If in each case the number of printing products necessary for a preliminary stack is fed alternately to a plurality of stack compartments, the time during which a stack compartment cannot be fed any printing products is in turn determined by the time requirement which is needed to transfer a preliminary stack to the bundle-forming unit and to close the stack compartment again by means of the slide plates. Ultimately, the number of required stack-forming devices is also determined by this time.

There is consequently a need to minimize the time during which a stack compartment cannot be fed any printing products.

A further stack-forming device having a stack compartment which can be closed at the bottom by slide plates and in which a number of printing products are stacked to form a preliminary stack is known from EP-A-0 348 610 and the corresponding U.S. Pat. No. 5,002,456. In order that the last, respectively, of the preliminary stacks transferred to the bundle-forming unit arranged underneath the slide plates does not have to be compressed between the depositing table and the slide plates before the ejecting of the finished stack out of the receiving space, and nevertheless the necessary stability of the finished stack is achieved, this prior art teaches feeding the printing products, with the fold ahead, to the stack compartment and supporting them on the side opposite the fold in the middle region by a supporting element which can be swung into the stack compartment. The printing products in this case assume a roof-like shape in the region opposite the fold. As a result, the processing time in the bundleforming unit can indeed be shortened, but not the time for emptying the stack compartment and closing it again by the slide plates.

German Offenlegungsschrift 31 30 945 and the corresponding U.S. Pat. No. 4,445,681 disclose an apparatus for extracting the printing products conveyed at great speed by means of a gripper conveyor from the conveyed stream. In the case of the triggering device for the grippers of the gripper conveyor there is provided a stop which, upon switching on and off of the triggering device, can be moved into the conveying path of the products and out of this conveying path, respectively. The printing products extracted from the conveyed stream and retarded at the stop fall directly into a stack compartment of a stack-forming device for forming a preliminary stack.

Finally, apparatuses for forming stacks from uninterruptedly arriving printing products are known from CH-A-648 262 and the corresponding U.S. Pat. No. 4,432,685 and CH-A-566 928. The apparatus according to the two first-mentioned documents has two stack compartments which can be turned about a vertical axis and are closed off at the bottom by a raisable and lowerable stacking table which can be moved in opposed mode between a receiving position at the outlet of a conveying device, designed as a belt conveyor, and a depositing position underneath a bundle-forming unit, which can be charged from below with preliminary stacks. Provided above the stack compartments, located in the receiving position, is an intermediate stacking device, which can be switched on during the movement of the stack compartments for forming an intermediate stack from the fed printing products. This intermediate stacking device fulfils the same purpose as the gap-forming device mentioned further above, namely to store continuously arriving printing products intermediately during a time in which they cannot be fed to a stack compartment. It is also proposed in CH-A-566 928 to provide an intermediate storing device in order to store intermediately in stack form the continuously fed printing products during the time which is required to transfer a preliminary stack from a stack compartment to a bundle-forming unit arranged underneath the latter and to close the stack compartment again. The stack compartment is in this case able to be closed by an inclined grating formed by two racks which can be swung in opposite directions but in common mode. The intermediate-stacking device has a separating member which is designed like a rack and which, as soon as a preliminary stack has formed, is swung into the path of the printing products leaving the outlet of a conveying device designed as a belt conveyor, so that they cannot fall into the stack compartment. At the same time as the swinging in, a downward movement of the separating member commences. This lasts until the last printing product fed to the stack compartment for forming a preliminary stack has reached the stacked printing products and the preliminary stack has been released to pass to the bundle-forming unit by a turning of the carrying racks. In this time, there forms on the lowering separating member a partial stack, which is then dropped onto the carrying racks, without a backlog occurring in the conveying device or the feeding of the printing products having to be interrupted.

An apparatus for forming stacks of plastic bags or carrier bags is disclosed in DE-A-23 57 658. Arranged underneath a bottom which can be moved into and out of the stack compartment is an intermediate bottom, which can likewise be moved into and out of the stack compartment and the vertical distance of which from the bottom corresponds at least to the height of a finished stack. The stack forming begins on the bottom moved into the stack compartment, so that the bags or carrier bags thrown off from a conveying device have to overcome only a small drop height. Before reaching the desired stack height, the bottom is opened, so that the stack falls onto the closed intermediate bottom. As soon as the stack has been formed completely on the intermediate bottom, the bottom is moved into the stack compartment, so that the next stack begins to form on said bottom. Once the bottom has been moved in, the stack is set down, by opening the intermediate bottom, on an intermittently or continuously circulating stack belt for carrying away. Subsequently, the intermediate bottom is closed again, in order that it can receive the following stack. This known apparatus allows continuous feeding of the bags or carrier bags, but only the formation of stacks of a small height is possible.

On the basis of this prior art, it is an object of the present invention to provide an apparatus of the general type in which the time during which no printing products can be fed to the stack compartment is as short as possible.

SUMMARY OF THE INVENTION

The above and other objects and advantages of the present invention are achieved by the provision of a stacking apparatus which comprises a vertical stack compartment having an open upper end and a lower end, and slide plates which are mounted for selective movement between an operative position closing the lower end of the vertical stack compartment and a laterally withdrawn position. An intermediate support member is mounted for selective movement between an operative position disposed in the vertical stack compartment at a predetermined distance above the slide plates, and a laterally withdrawn position. Also, bundle forming means is mounted below the vertical stack compartment and includes a deposit table which may be lifted and lowered. A control means is also provided for controlling the operation of the slide plates and the intermediate support member, so that a preliminary stack of the products may be formed on the intermediate support member, and the preliminary stack may then be dropped onto the slide plates by moving the intermediate support member to its laterally withdrawn position and thereby permit formation of a complete stack on the slide plates. The complete stack may be dropped onto the deposit table by moving the slide plates to their withdrawn position, and so that the intermediate support member then may be promptly moved to its operative position to receive additional serially delivered products.

The intermediate support member which can be moved into and out of the stack compartment makes it possible to feed printing products to the stack compartment before the slide plates can close the stack compartment after it has been emptied. In addition to the time gain, the drop height of the printing products is also reduced, which results in stacks of a higher quality. This reduction in the drop height also allows high stack compartments to be provided for forming large preliminary stacks. Moreover, by virtue of the small drop height, multi-sheeted, thick printing products which can be fed at high speed can be stacked to form preliminary stacks of good quality.

Further preferred embodiments of the apparatus according to the invention, and a preferred process for operating the apparatus are set forth below.

BRIEF DESCRIPTION OF THE DRAWINGS

The invention is now described in more detail with reference to an illustrative embodiment represented in the drawing, in which purely diagrammatically.

DETAILED DESCRIPTION OF THE PREFERRED EMBODIMENT

Figure 1:
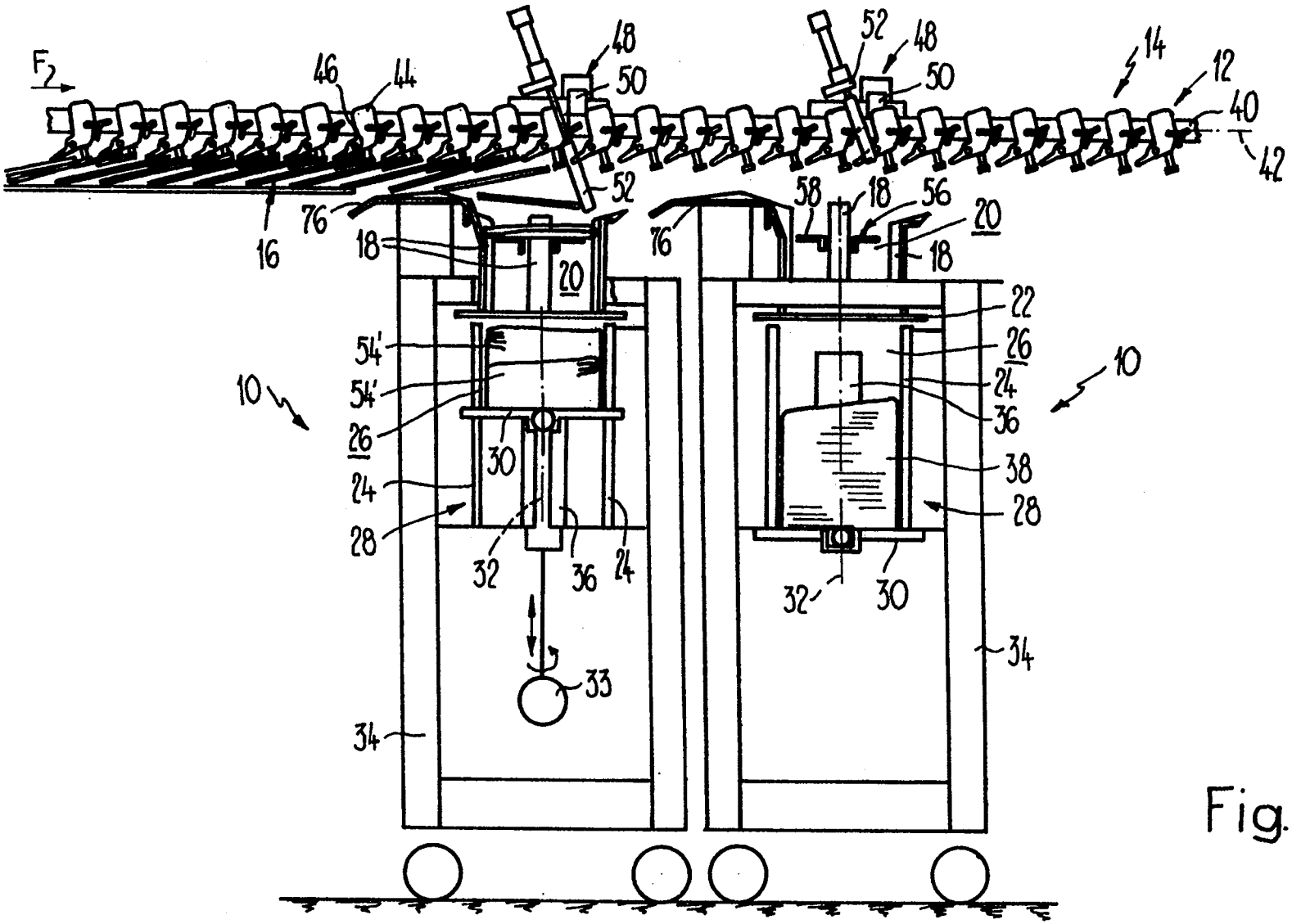
FIG. 1 shows, in elevation and partially sectioned, two identical stack-forming devices arranged underneath a gripper conveyor.

FIG. 1 shows two stack-forming devices 10 which are arranged next to each other and over which there runs a conveying device 14, designed as a gripper conveyor 12, for feeding printing products 16 to the stack-forming devices 10.

Each stack-forming device 10 has a vertical stack compartment 20, which is defined by delimiting bars 18 and can be closed at the bottom by means of slide plates 22 which can be moved in the horizontal direction toward each other and away from each other. Underneath the slide plates 22 there adjoins a receiving space 26 of a bundle-forming unit 28, delimited on two mutually opposite sides by guide bars 24. The receiving space 26 is delimited at the bottom by a raisable and lowerable depositing table 30, which can also be turned together with the guide bars 24 about a vertical axis 32. The drive for the depositing table 30 is indicated diagrammatically and denoted by 33. The delimiting bars 18 of the stack compartment 20 are arranged adjustably in a known manner on a movable frame 34 in order to adapt the stack compartment 20 to the format of the printing products to be processed. Also arranged on the same frame 34, in a known manner, is the bundle-forming unit 28 together with the drive 33.

Furthermore, the stack-forming device 10 has an ejecting device 36, in order to eject the finished stacks 38, respectively formed in the bundle-forming unit 28, from the receiving compartment 26 for further processing. As far as the construction and operating principle of the stack-forming device 10 are concerned, reference is made expressly to DE-A-27 52 513 or the corresponding CA-A-1,091,707, to CH-A-623 286, to CH-A-623 288 or the corresponding U.S. Pat. No. 4,214,743 and to CH-A-623 287 or the corresponding U.S. Pat. No. 4,229,134.

The gripper conveyor 12 has, in the manner known per se, on a drawing member 42, guided in a channel 40, individually controllable grippers 44 arranged at fixed intervals one behind the other. The drawing member 42 is driven to circulate in conveying direction F and the grippers 44 have mouths directed against the conveying direction F, in order to transport the printing products 16, individually held in the region of their leading edge 46.

The conveying device 14 has further above each stack-forming device 10 an extracting device 48 for the optional extracting of printing products 16 from the conveyed stream. In the switched-on state, a triggering device 50, which can be switched on and off, of the extracting device 48 opens the grippers 44 running past, so that they release the respective printing products 16. Each triggering device 50 is assigned a stop member 52, which can be moved into the conveying path of the printing products 16 and out of this conveying path upon switching on and off, respectively, of the triggering device 50. The printing products 16 extracted from the conveyed stream hit with their leading edge 46 against the stop member 52, as a result of which they are retarded and fall from above into the stack compartment 20 of the corresponding stack-forming device 10. As far as the construction and the operating principle of the conveying device 14 with the extracting device 48 are concerned, reference is made expressly to DE-A-31 30 945 and the corresponding U.S. Pat. No. 4,445,681.

Figure 2:
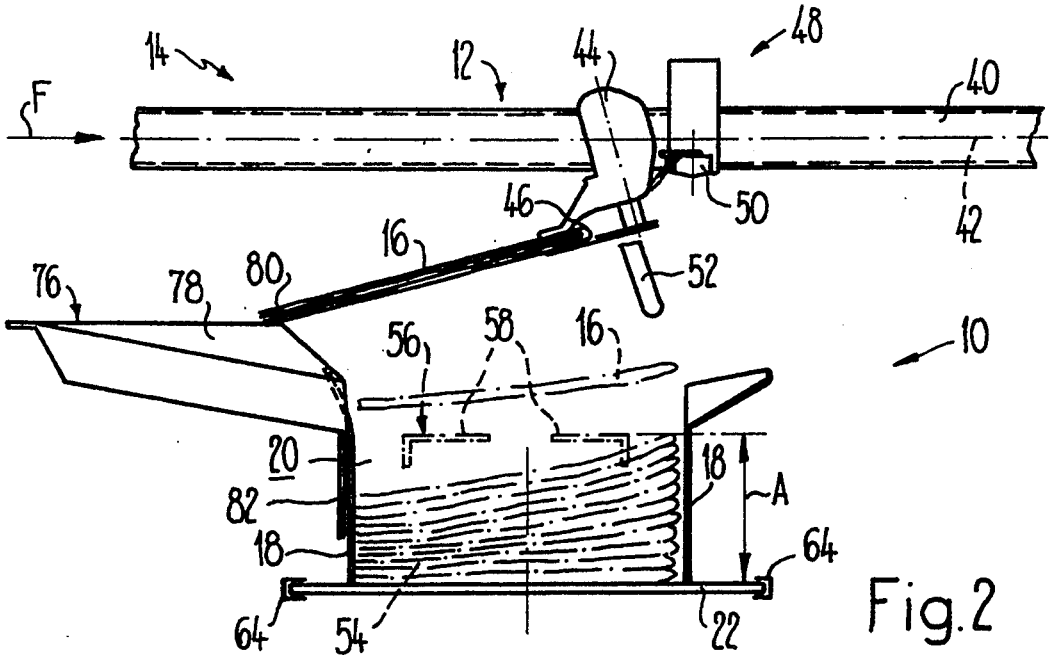
FIGS. 2 and 3 show, in elevation and side view, respectively, partially sectioned and enlarged, a part of the gripper conveyor shown in FIG. 1 and of the stack-forming device shown in FIG. 1.
Figure 3:
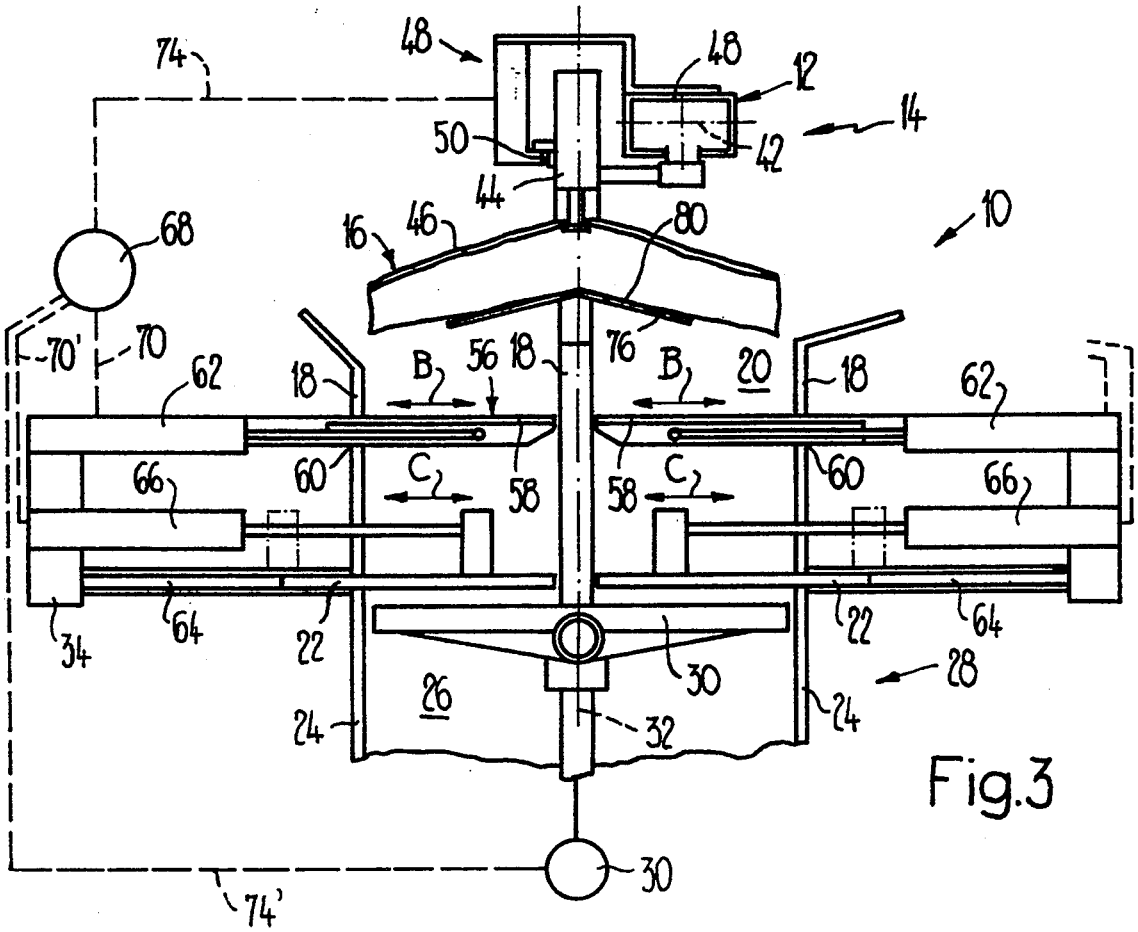

A certain number of printing products 16 are in each case extracted by means of the extracting device 48 from the conveyed stream transported by the gripper conveyor 12 in conveying direction F, and from these printing products 16 a preliminary stack 54 is formed in the stack compartment 20 of the corresponding stack-forming device 10, see also FIGS. 2 and 3. Due to the moving apart of the two slide plates 22, the respective preliminary stack 54 then falls onto the depositing table 30, or onto the preliminary stack 54' already located thereupon, for forming a finished stack 38 with preliminary stacks 54' turned with respect to one another through 180° in each case.

As emerges from FIG. 1, but in particular from FIGS. 2 and 3, the stack-forming device 10 has an intermediate support member or bottom 56, which can be moved in and out of the stack compartment 20 in a horizontal direction at a distance A of the slide plates 22. It has two intermediate-bottom elements 58, which can be pushed toward each other and away from each other in the direction of arrow B and which, as emerges particularly clearly from FIG. 2, are of a fork-like design, in order to be able to engage on both sides of the corresponding delimiting bars 18 into the stack compartment 20. The intermediate-bottom elements 58 are mounted displaceably on guide elements 60, supported on the frame 34, and are each coupled to a cylinder-piston unit 62. The intermediate-bottom elements 58 are displaceable back and forth in the same direction of movement B as the two slide plates 22, the directions of movement of which are indicated by the double-headed arrow C. The slide plates 22, mounted displaceably in C-shaped guide rails 64, fastened on the frame 32, are likewise each connected to a further cylinder-piston unit 66.

The cylinder-piston units 62 and further cylinder-piston units 66 are activated by a control device 68, as is indicated by the lines 70, 70', drawn in a dot-dashed form. The same control device 68 also controls the extracting device 48 with the triggering device 50 and the stop member 52, as well as the drive 33 of the depositing table 30, as is indicated by the dot-dashed lines 74, 74' and the ejecting device 36.

The stack compartment 20 of each stack-forming device 10 is assigned a bending member 76, which is arranged upstream in conveying direction F of the stack compartment 20 concerned and is arranged on the frame 34. The bending member 76 has a roof-like shaped perforated sheet 78, the bending line of which extends approximately in conveying direction F. The transported printing products 16, hanging obliquely downward in the region of their leading edge 46, are supported in their trailing end region 80 by the perforated sheet 78, as a result of which the printing products 16 are bent in a roof-like manner about a bending line running approximately in conveying direction F, as is evident in particular from FIG. 3 and is also described and shown in DE-A-31 30 945 or the corresponding U.S. Pat. No. 4,445,681, This gives the printing products 16 a high intrinsic stability in order to prevent damage upon hitting the stop member 52 and ensures a stable drop into the stack compartment 20. The perforated sheet 78 is connected via a diagrammatically indicated vacuum line 82 to a negative-pressure source (not shown), in order to exert a retarding effect on the printing products 16 extracted from the conveyed stream. Together with the stop member 52, this allows thick, multi-sheeted printing products 16 to be extracted from the conveyed stream, even if fed at high speed, and to be dropped into the respective stack compartment 20.

Figures 4, 5, 6, 7, 8, 9:
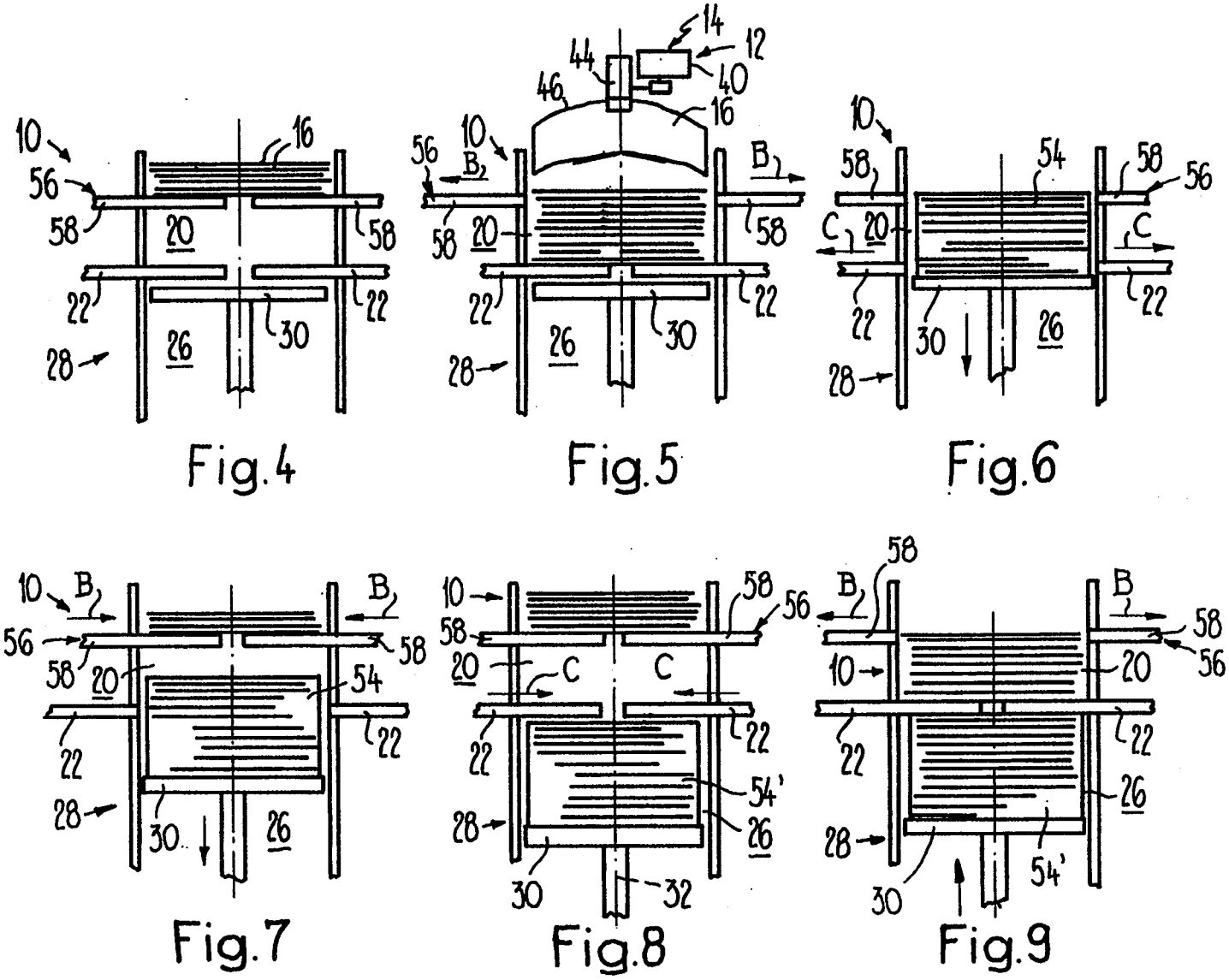
FIGS. 4 to 9 show, greatly simplified in comparison with FIGS. 1 to 3, a stack-forming device at six different points in time of a processing cycle.

The operating principle of the apparatus shown in FIGS. 1 to 3 is now described with reference to FIGS. 4 to 9. These in each case show, greatly simplified, the stack compartment 20 with the two slide plates 22 and the intermediate-bottom elements 58, and of the bundle-forming unit 28 the receiving space 26 with the depositing table 30. In addition, the gripper conveyor 12, feeding the printing products 16 is indicated in FIG. 5.

When the stack-forming device 10 is put into operation, the intermediate-bottom elements 58 have been moved into the stack compartment 20, and the latter is closed at the bottom by the slide plates 22, which have been pushed toward each other leaving a gap. The depositing table 30 has been raised into its upper end position, where it is located a small distance below the slide plates 22, as FIG. 4 shows. Then, the extracting device 48, assigned to a stack-forming device 10, is switched on, as is indicated in FIG. 1 in the case of the stack-forming device 10 shown on the left. As a result, printing products 16 are successively extracted from the conveyed stream and they fall onto the intermediate-bottom elements 58, where they are stacked (compare in particular FIGS. 1 and 4). As soon as there is a certain number of printing products 16 on the intermediate-bottom elements 58, or the partial preliminary stack formed thereby has reached a certain height, the intermediate-bottom elements 58 are drawn away from each other out of the stack compartment 20, which has the consequence that the partial preliminary stack falls onto the slide plates 22 (FIG. 5), at the same time as which further printing products 16 are fed until the preliminary stack 54 formed in the stack compartment 20 has the desired number of printing products 16. The height of the preliminary stack 54 may in this case be greater than the clear span between the intermediate bottom 56 and the slide plates 22.

Then, the extracting device 48 is switched off and the extracting device 48 assigned to the stackforming device on the right in FIG. 1 is activated, so that then a preliminary stack 54 can be formed in precisely the same manner in the stack compartment 20 of this stack-forming device 10. The finished preliminary stack 54 is deposited on the depositing table 30 by the slide plates 22 being drawn apart as soon as the last fed printing product 16 has completed the preliminary stack 54. As is indicated in FIG. 6 by the downwardly pointing arrow, the depositing table 30 is then lowered and, as soon as the preliminary stack 54 has passed the intermediate-bottom elements 58, the latter are moved into the stack compartment 20 again (FIG. 7). Then, the formation of a new preliminary stack 54 can be begun again on said elements, while the depositing table 30 is lowered to the extent that the entire preliminary stack 54 enters into the receiving space 26. Then, the stack compartment 20 is closed at the bottom again by the slide plates 22 moving toward each other, and the depositing table 30 is turned together with the receiving space 26 and the preliminary stack 54', located in it, through 180° about the vertical axis 32, as is indicated in FIG. 8 by the arrow.

As soon as the desired number of fed printing products 16 have been stacked on the intermediate-bottom element 58 to form a partial preliminary stack, the intermediate-bottom elements 58 are again drawn out of the stack compartment 20 and a second preliminary stack 54 is completed on the slide plates 22, with further printing products 16 being fed. During this time, the depositing table 30 is raised, as FIG. 9 shows, in order to compress the preliminary stack 54' between said table and the slide plates 22. This compressing results in a compact, stable finished stack 38. After pressing, the depositing table 30 is lowered slightly again, until the preliminary stack 54' is no longer bearing against the slide plates 22 (approximately as shown in FIG. 8).

As soon as the second preliminary stack 54 has been completely formed in the stack compartment 20, the slide plates 22 are again drawn apart, as a result of which this preliminary stack 54 is set down on the preliminary stack 54' located in the receiving space 26. The depositing table 30 is then lowered, and the intermediate-bottom elements 58 are moved in, in order to permit the formation of a further preliminary stack 54, as is shown in FIG. 1 by the stack-forming device 10 shown on the left. In precisely the same manner as described further above, the slide plates 22 are then moved in again, the two preliminary stacks 54, 54', lying one on top of the other, are turned through 180° about the vertical axis 32 and pressed. This is repeated until a finished stack 38 with the desired number of printing products 16 has been formed from preliminary stacks 54' turned with respect to one another and lying one on top of the other. For carrying the finished stack 38 away, the depositing table 30 is lowered into its lower end position, which is the case with the stack-forming device 10 shown on the right in FIG. 1. Then, the ejecting device 36 is activated in order to push the finished stack out of the receiving space 26. Said stack can then be fed to a further processing station.

For the sake of completeness, it should be mentioned that a stack compartment 20 in each case cannot be fed any printing products 16 if the intermediate-bottom elements 58 and slide plates 22 have been moved out of the stack compartment 20.

Apart from the splitting of the product stream over stack-forming devices 10 arranged one after the other, as is shown in FIG. 1, it is also conceivable to provide between a conveying device 10 continuously feeding printing products 16, for example the gripper conveyor 12, and the stack compartment 20 of a stack-forming device 10 a gap-forming device, as is disclosed, for example, in DE-A-27 52 513 or the corresponding CA-A-1,091,707 and CH-A-623 286. It goes without saying that it would also be possible with the conveying device to feed the desired number of printing products forming a preliminary stack 54 section by section to a stacking device 10 and in each case feed a further section as soon as the intermediate bottom is ready for beginning a new preliminary stack formation.

In the case of single-sheeted or few-sheeted folded printing products, it may not be necessary to deposit the preliminary stacks one on top of the other in a turned relationship with respect to one another to form a finished stack. In this case, the drive 33 is activated in such a way that the depositing table 30 executes only one lifting and lowering movement.

The intermediate bottom can be put into operation or shut down as and when needed. Likewise, it is possible to form preliminary stacks of different heights and to bring them together to form a finished stack.

What is claimed is:

1. An apparatus for forming stacks of folded printing products, such as newspapers and periodicals, which are serially delivered thereto, and comprising means defining a vertical stack compartment (20) having an open upper end and a lower end, and including slide plate means (22), and means (66) mounting said slide plate means for selective movement between an operative position closing the lower end of said vertical stack compartment and a laterally withdrawn position, intermediate product support means including an intermediate support member (56), and means (62) mounting said intermediate support member for selective movement between an operative position disposed in said vertical stack compartment at a predetermined distance (A) above said slide plate means, and a laterally withdrawn position, bundle forming means (28) mounted below said vertical stack compartment and including a deposit table (30), and means (33) for selectively raising and lowering said deposit table, and control means for controlling the operation of said mounting means (66) for said slide plate means and said mounting means (62) for said intermediate support member so as to operate in a sequence wherein a preliminary stack (54) of the products is formed on said intermediate support member, the preliminary stack is then dropped onto said slide plate means by moving said intermediate support member to its laterally withdrawn position and thereby permit formation of a complete stack on said slide plate means, the complete stack is then dropped onto said deposit table by moving said slide plate means to its withdrawn position, and when the complete stack is below the elevation of said intermediate support member, the intermediate support member is then promptly moved to its operative position to receive additional serially delivered products.

2. The apparatus as defined in claim 1 wherein said bundle forming means further comprises means for selectively rotating said deposit table about a vertical axis by at least about 180 degrees.

3. The apparatus as defined in claim 3 wherein said intermediate support member comprises two elements which are moveable toward and away from each other by said mounting means (62).

4. The apparatus as defined in claim 3 wherein said slide plate means comprises two plates which are moveable toward and away from each other by said mounting means (66).

5. The apparatus as defined in claim 1 further comprising means for serially delivering the folded printing products along a horizontal path of travel and into the open upper end of said vertical stack compartment.

6. The apparatus as defined in claim 5 further comprising a product bending member mounted along said path of travel for bending the advancing products into an angled configuration which includes a fold line disposed parallel to said path of travel.

7. The apparatus as defined in claim 5 wherein said product bending member comprises a perforated plate, and suction means for drawing air through said perforated plate.

8. The apparatus as defined in claim 5 wherein said delivering means includes conveyor means (14) which is positioned to run laterally across said open upper end of said vertical stack compartment, a plurality of individually controllable grippers (44) mounted serially along said conveyor means for respectively holding the printing products, and triggering means (50) mounted above said open upper end of said vertical stack compartment for selectively releasing the grippers so that the associated printing product falls into said open upper end of said vertical stack compartment.

9. The apparatus as defined in claim 5 wherein said delivering means further includes a stop element (52) for engaging and retarding the advance of the printing products upon release thereof by said triggering means.

10. An apparatus for forming stacks of folded printing products, such as newspapers and periodicals, which are serially delivered thereto, and comprising at least two stack forming assemblies positioned adjacent to each other, with each assembly comprising (a) means defining a vertical stack compartment (20) having an open upper end and a lower end, and including slide plate means (22), and means (66) mounting said slide plate means for selective movement between an operative position closing the lower end of said vertical stack compartment and a laterally withdrawn position, (b) intermediate product support means including an intermediate support member (56), and means (62) mounting said intermediate support member for selective movement between an operative position disposed in said vertical stack compartment at a predetermined distance (A) above said slide plate means, and a laterally withdrawn position, (c) bundle forming means (28) mounted below said vertical stack compartment and including a deposit table (30), and means for selectively raising and lowering said deposit table, and (d) control means for controlling the operation of said mounting means (66) for said slide plate means and said mounting means (62) for said intermediate support member so as to operate in a sequence wherein a preliminary stack (54) of the products is formed on said intermediate support member, the preliminary stack is then dropped onto said slide plate means by moving said intermediate support member to its laterally withdrawn position and thereby permit formation of a complete stack on said slide plate means, the complete stack is then dropped onto said deposit table by moving said slide plate means to its withdrawn position, and when the complete stack is below the elevation of said intermediate support member the intermediate support member is then promptly moved to its operative position to receive additional serially delivered products, and means for serially delivering the folded printing products along a horizontal path of travel which extends across the open upper end of said vertical stack compartment of each of said assemblies and for selectively releasing the printing products into each of said open upper ends.

11. A method of forming stacks of folded printing products, such as newspapers and periodicals, and comprising the steps of (A) providing a stack forming assembly which comprises (a) means defining a vertical stack compartment (20) having an open upper end and a lower end, and including slide plate means (22), and means (66) mounting said slide plate means for selective movement between an operative position closing the lower end of said vertical stack compartment and a laterally withdrawn position, (b) intermediate product support means including an intermediate support member (56), and means (62) mounting said intermediate support member for selective movement between an operative position disposed in said vertical stack compartment at a predetermined distance (A) above said slide plate means, and a laterally withdrawn position, (c) bundle forming means (28) mounted below said vertical stack compartment and including a deposit table (30), (B) moving said intermediate support member and said slide plate means to their respective operative positions, (C) serially delivering printing products so as to form a preliminary stack of printing products upon said intermediate support member, (D) moving the intermediate support member to its withdrawn position so that the preliminary stack falls onto said slide plate means, (E) serially delivering additional printing products onto said preliminary stack so as to form a complete stack, (F) moving said slide plate means to its withdrawn position so that the complete stack falls onto said deposit plate, and (G) cyclically repeating steps (B) through (F), and wherein repeated step (B) includes moving said intermediate support member to its operative position promptly after step (F) and when the complete stack is below the elevation of said intermediate support member and so as to permit prompt initiation of step (C) before the slide plate means is able to be moved to its operative position by reason of the presence of the complete stack.

12. The method as defined in claim 11 wherein said bundle forming means includes means mounting said deposit table for selective vertical movement between a raised position immediately below said slide plate means, and a lowered position, and comprising the further step of positioning the deposit table in its raised position during step (F) and subsequently moving the deposit table to its lowered position.

13. The method as defined in claim 12 wherein said means mounting said deposit table includes means for permitting selective rotation thereof about a vertical axis, and comprising the further step of rotating the deposit table about said axis by about 180 degrees after step (F).

14. The method as defined in claim 12 comprising the further step of lifting the deposit table from its lowered position to a lifted position after step (F) and after repeated step (B), and so as to compress the completed stack against said slide plate means, and subsequently lowering said deposit table to said lowered position and laterally removing the completed stack therefrom.

15. The method as defined in claim 1 wherein the complete stack formed in step (E) has a height which extends above the elevation of the intermediate support member, and wherein repeated step (B) includes moving said intermediate support member to its operative position as soon as the complete stack drops below the elevation of said intermediate support member.

* * * * *

UNITED STATES PATENT AND TRADEMARK OFFICE

CERTIFICATE OF CORRECTION

PATENT NO. : 5,370,382

DATED : December 6, 1994

INVENTOR(S) : Wetter

It is certified that error appears in the above-identified patent and that said Letters Patent is hereby corrected as shown below:

Column 9, line 14, "3" should be -- 2 --.

Column 12, line 12, "1" should be -- 11 --.

Signed and Sealed this

Fourth Day of July, 1995

Bruce Lehman

*Attest:*

BRUCE LEHMAN

*Attesting Officer*

*Commissioner of Patents and Trademarks*